United States Patent [19]

Hill

[11] Patent Number: 4,917,120

[45] Date of Patent: Apr. 17, 1990

[54] NICOTINE IMPACT MODIFICATION

[75] Inventor: Ira D. Hill, Locust, N.J.

[73] Assignee: Advanced Tobacco Products, Inc., San Antonio, Tex.

[21] Appl. No.: 308,936

[22] Filed: Feb. 7, 1989

Related U.S. Application Data

[63] Continuation of Ser. No. 866,073, May 21, 1986, abandoned.

[51] Int. Cl.[4] ..... A24D 1/00; A24F 1/00

[52] U.S. Cl. ..... 131/271; 131/273; 546/281

[58] Field of Search ..... 131/270–271, 131/272, 273, 335; 546/281; 514/343

[56] References Cited

U.S. PATENT DOCUMENTS 1,776,862 9/1930 Lindstaedt .
2,139,839 12/1938 McKinney .
3,109,436 11/1963 Bavley et al. .
3,280,823 10/1966 Bavley et al. .
4,340,072 7/1982 Bolt et al. .

*Primary Examiner*—V. Millin
*Attorney, Agent, or Firm*—Arnold, White & Durkee

[57] ABSTRACT

Compositions comprising nicotine and a volatile nicotine-miscible substance may be used to create sources of modulated nicotine vapor. The modulation of nicotine vapor may be one of quantity or of perceived physiological impact or a combination of both. The substance should have a volatility somewhat similar to that of nicotine and have a normal boiling point between about 175° C. and about 275° C. These compositions may be placed in the nicotine reservoir of a personal oral nicotine inhaler. Esters are preferred nicotine miscible substances, particularly when substantially flavorless and generally recognized as safe for human consumption. Nicotine and nicotine-miscible substance in a weight/-weight ratio between about 0.5 and 40.0 are emplaced in a nicotine reservoir, for example absorbed in a porous polyethylene item, for insertion into the tubular passageway of a smokeless cigarette.

11 Claims, 2 Drawing Sheets

NICOTINE IMPACT MODIFICATION

This is a continuation of copending Ser. No. 866,073, filed 5/21/86, now abandoned.

BACKGROUND OF THE INVENTION

The present invention relates to compositions of nicotine with nicotine impact modification agents and uses of such compositions.

Nicotine may be used in the construction of tobacco substitutes. Non-combustible cigarette substitutes, which may be termed "smokeless cigarettes" or "personal oral nicotine inhalers", preferably contain purified nicotine which is dispensed to passing air. Such a smokeless cigarette is described in U.S. Pat. No. 4,284,089, assigned to the assignee of the present invention.

Of particular significance in the design and construction of smokeless cigarettes is the control of parameters relating to nicotine dispensation. These parameters include:

1. the perceived impact of volatilized nicotine upon the oral and respiratory tissues of one using such a smokeless cigarette;
2. the duration during usage of consistent volatilized nicotine emissions from such a smokeless cigarette; and
3. the ability to construct mildly-perceived smokeless cigarettes without unacceptably detracting from the self-life of such a product.

The perceived impact of volatile nicotine obtained by use of a personal oral nicotine inhaler is important for the satisfaction of users of such inhalers. For example, a user accustomed to the sensation accompanying inhalation of a strong or unfiltered cigarette is likely to desire a sensation upon oral and respiratory tissues which might be regarded as irritating and unpleasant by a less hardened user. This less hardened user, for example one accustomed to the use of highly filtered cigarettes, is likely to desire much less perceived nicotine impact.

Features of the present invention relate to nicotinaceous mixtures usable in personal nicotine inhalers. Such nicotinaceous mixtures may be produced to modify the perceived impact of volatilized nicotine inhaled from personal oral nicotine inhalers without overwhelming the user with an alien flavor.

It is known in the tobacco product industry that certain highly flavored additives may "smooth" or reduce the harsh irritation of nicotine-containing tobacco smoke. For example, additives such as 1-menthol; menthol analogs; cocoa; licorice root extract, and similar aromatic materials may be added to tobacco. These additive, at levels below their own threshold of perception, appear to aid in reducing the perceived impact of inhaled nicotine. These materials may also be added to the nicotine of personal oral nicotine inhalers. Such additions (typically levels of less than 0.1 weight percent of nicotine) have been made with the nicotine of smokeless cigarettes. When nicotine is inhaled from such a fortified smokeless cigarette, the perceived nicotine impact is generally viewed as smoother. These flavorful additives however are limited for the production of a smooth-tasting nicotine inhalant without imparting their own taste. When such additives are added to tobacco or to nicotine above their levels of taste perception, the perceived taste of inhaled smoke or nicotine becomes identified with the additive itself.

An object of the present invention is to smooth the perceived impact of nicotine inhaled from a personal oral nicotine inhaler such as a smokeless cigarette. Such smoothing should not add unwanted flavors and should also, if possible, add to the shelf life of a smokeless cigarette. Additionally, any such smoothing agents should be generally regarded as safe (GRAS) for consumption. These latter requirements may also be regarded as advantages inherent in the present invention.

The vapor pressure of a volatile liquid is subject to a variety of physical conditions such as pressure temperature or mixture with other volatile liquids. The vapor pressure of liquids is influenced by the presence of miscible liquids in a manner governed by Raolt's law, at least if the liquids are ideal and their admixture is an ideal solution.

For two ideal solvents in a solution, Raoult's law may be expressed as:

$$p_1 = N_1\, p_{lorig}.$$

where: pl is the partial vapor pressure of ideal solvent 1 in an ideal solution with ideal solvent 2; $N_1$ is the mole fraction of solvent 1; and $p_{lorig}$ is the vapor pressure of pure solvent 1. An object of the present invention is to take advantage of the principle of Raoult's law to facilitate smooth and consistent intakes of nicotine from a personal oral nicotine inhaler such as a smokeless cigarette.

SUMMARY OF THE INVENTION

Compositions comprising nicotine and a volatile nicotine-miscible substance may be used to create sources of modulated nicotine vapor. The modulation of nicotine vapor may be either (1) of quantity or (2) of physiological impact or (3) combination of both. The substance should have a volatility somewhat similar to that of nicotine and have a normal boiling point between about 175° C. and about 275° C. These compositions may be placed in the nicotine reservoir of a personal oral nicotine inhaler. Esters are preferred nicotine miscible substances, particularly when substantially flavorless and generally recognized as safe for human consumption. Nicotine and nicotine-miscible substance in a weight/weight ratio between about 0.5 and 40.0 (i.e., the composition is preferably from about 33.3% nicotine to about 97.5% nicotine) are emplaced in a nicotine reservoir, for example, absorbed in a porous polyethylene item for insertion into the tubular housing of a smokeless cigarette.

DESCRIPTION OF PREFERRED EMBODIMENTS

The present invention relates to the discovery that the perceived impact of inhaled nicotine may be smoothed by the presence of certain companion volatile substances. Such substances preferably have no perceptible flavor or taste but may, if desired for particular purposes, have a selected flavor. Glyceryl triacetate (Triacetin TM, Eastman Chemical, Kingport, Tenn.) has been tested as a model substance for this purpose since it is generally regarded as safe (GRAS) by the Food and Drug Administration and has a volatility in the same range as that of nicotine. Although vapor pressures and boiling points are not always directly related, the relative volatility of a pair of compounds is usually reflected by the relationship of their boiling points. For the purposes of the present invention, a boiling temperature at about atmospheric pressure (760 mm Hg) is referred to as a normal boiling point.

Figure 1:
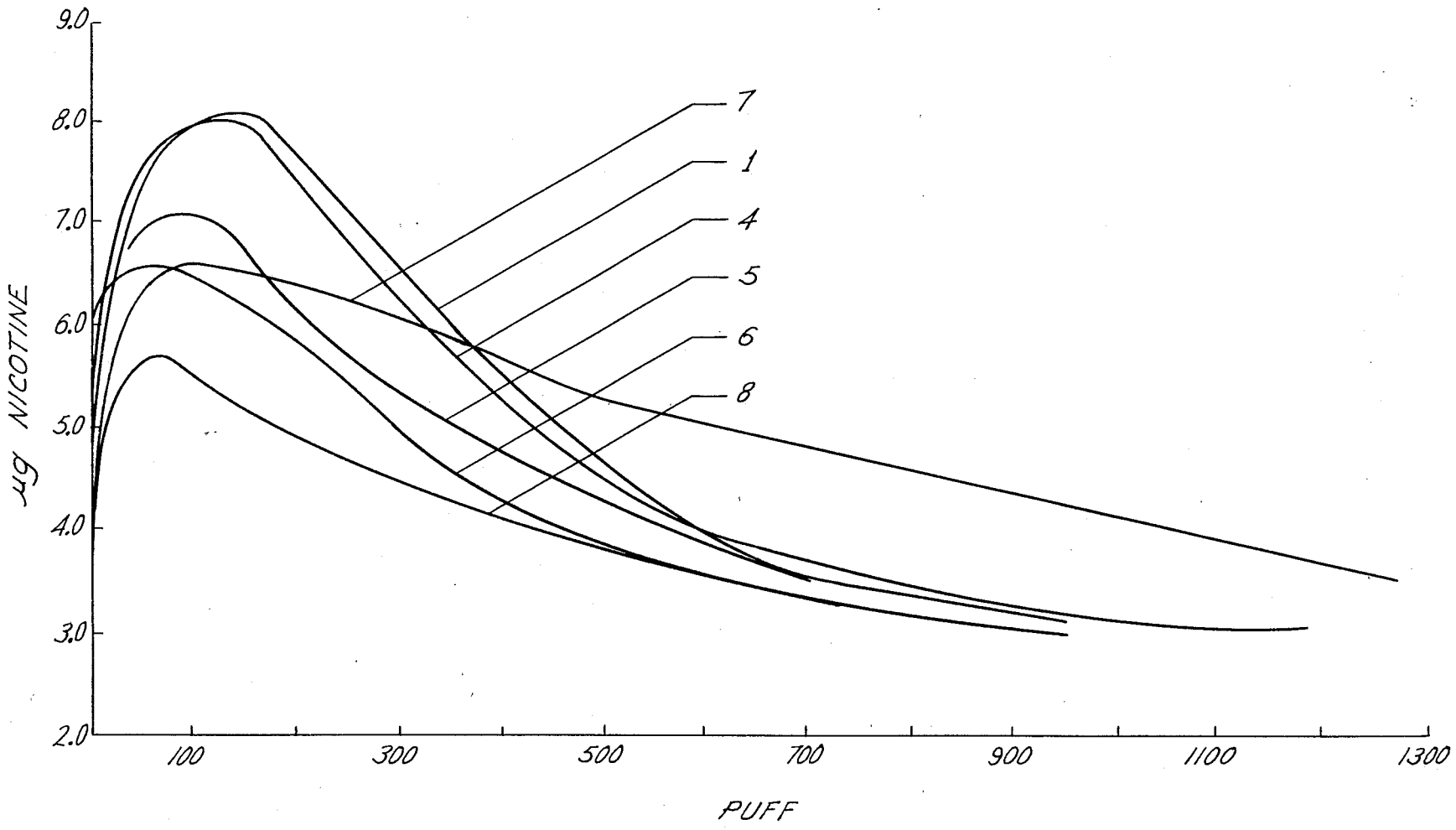
FIG. 1 shows patterns of nicotine emission in puffs of air drawn through a smokeless cigarette loaded with nicotine and various amounts of glyceryl triacetate.
Figure 2:
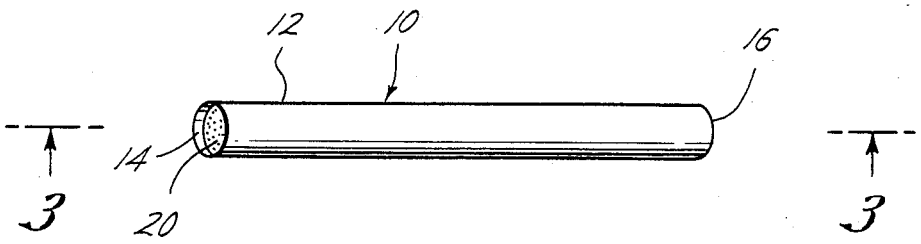
FIG. 2 shows a perspective view illustrating an embodiment of a personal nicotine inhaler of the present invention.
Figure 3:
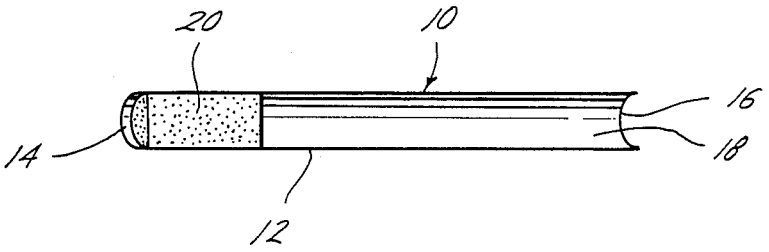
FIG. 3 shows a cross-sectional view taken along line 3—3 of FIG. 2.

FIGS. 1 and 2 show a personal oral nicotine inhaler 10 such as a smokeless cigarette comprising a housing 12 having a first open end 16 and a mouthpiece open end 16 and a tubular passageway 18 between those open ends 14, 16. Contained in the passageway 18 is a nicotine reservoir 20. The nicotine reservoir 20 is adapted to liberate volatilized nicotine when air is inhaled through the passageway 18 of the personal oral nicotine inhaler 10. Contained in the reservoir 20 is a composition comprising nicotine and a volatile substance or diluent miscible with nicotine. The nicotine and nicotine-miscible volatile substance are generally present in a weight/-weight ratio between about 0.5 and about 40.0. The volatile substance preferably has a normal boiling point between about 175° C. and about 275° C. One function of the volatile substance may be to modulate the vaporization of nicotine in a manner consistent with Raoult's law. This substance is most preferably an ester and lessens the sensory impact of volatilized nicotine as the mucous tissues of a user of the personal oral nicotine inhaler. In most preferred circumstances the volatile substance is generally recognized as safe for human consumption. In many cases the most satisfactory substance may be a diol or troil at least partially esterified with an alkyl carboxylic acid having four or less carbon atoms to produce an ester having a normal boiling point between about 175° C. and about 275° C. A similar ester of ethanol and an alkyl carboxylic acid having more than four carbon atoms may also be utilized as such a substance. Glyceryl triacetate is a specifically preferred volatile nicotine-miscible substance. The substance miscible (i.e. mutually soluble) with nicotine may be loaded with nicotine in the nicotine reservoir. When such loading occurs, the effective vapor pressure of nicotine in the reservoir varies relative to the mole fraction of nicotine present in the nicotine mixture of the reservoir. When a standard amount of nicotine is contained in a nicotine reservoir, the presence of increasing amounts of a miscible substance tends to decrease the concentration of nicotine released into passing air.

In a case where the nicotine and miscible substance have about the same vapor pressure, gaseous nicotine is liberated into passing air at about the same rate as the substance. Thus the relative molar ratios do not significantly change as both the nicotine and substance evaporate at about the same rate into passing air over a period of time. Thus the rate of nicotine liberation may be decreased and the duration of nicotine liberation may be proportionately longer.

A substance having a volatility different from that of nicotine may be chosen for mixture with nicotine in a composition for a nicotine reservoir. Of particular interest is the case where the substance has a greater volatility than that of nicotine (e.g. with lower normal boiling point). In this situation the substance may evaporate from its composition in a nicotine reservoir more quickly than nicotine. The molar proportion of nicotine in the mixture would rise as air passes about or through the reservoir and carries away more substance than nicotine. As the proportion of nicotine increases, so does the rate at which nicotine volatilizes into passing air. Thus particular compositions of nicotine and miscible substances may be designed to facilitate patterns of nicotine liberation to air passing through a smokeless cigarette. These patterns concern both nicotine concentrations and the duration of nicotine liberation.

Although esters, as preferred nicotine-miscible impact modifiers, may be used to smooth perceived nicotine impact and to impart changed patterns of nicotine liberation with smokeless cigarettes, such esters may also be chosen and used to add flavors if desired.

Additionally, certain virtually flavorless esters have been found to lessen the perceived impact of gaseous nicotine on the sensing systems of oral, pharyngeal or lung mucous tissue. Esters miscible with nicotine, according to processes of the present invention, may have at least three effects: to decrease the rate of nicotine liberation; to add flavor to liberated nicotine; or to favorably alter the perceived impact of nicotine from a personal oral nicotine inhaler without the addition of a newly perceived flavor or concomitant reduction of actual nicotine liberation.

Perhaps the most important object of the present invention involves this third effect, namely alteration of perceived nicotine impact. This impact could of course be altered by the lowering of nicotine in the reservoir and therefore in air drawn through or by the reservoir. Merely lowering the nicotine content of the reservoir however tends to unacceptably shorten the shelf life of a smokeless cigarette packaged with less than a perfect seal. A lowering of nicotine content also reduces user satisfaction in as much as a portion of the satisfaction from usage of tobacco or tobacco derived products is a function of nicotine quantities delivered to the brain.

Esters useful in the practice of the present invention include nicotine-miscible esters having a normal boiling point between about 175° C. and about 275° C. These esters include alkyl diols or triols at least partially esterified with an alkylcarboxylic acid containing four or less carbon atoms. Esters of ethanol and an alkyl carboxylic acid may also be used in the practice of the present invention.

Glyceryl triacetate has been found to be particularly satisfactory in the practice of aspects of the present invention. Glyceryl triacetate (mol. wt. 218.20, normal bp 258°–261° C.) is an oily liquid. For practical purposes glyceryl triacetate is essentially flavorless and has a normal boiling point similar to that of nicotine (247° C. at 745 mmHg)

The impact of nicotine is due to its irritating effects on sensory nerves of mucous tissue. An important aspect of the present invention relates to the discovery that a minor amount of glyceryl triacetate serves to lessen the perceived irritative effect of nicotine. Thus glyceryl triacetate may be added to nicotine in a nicotine reservoir of a smokeless cigarette. The result of this addition is an emitted nicotine at only slightly reduced levels, with unaltered flavor and taste, but with a perceived impact smoothed to a greater extent than could be produced simply by reducing nicotine delivery.

Glyceryl triacetate thus possesses properties approaching ideal in the practice of important aspects of the present invention. It is substantially tasteless and flavorless; has a volatility similar to that of nicotine; is mutually soluble with nicotine; is generally regarded as safe for human consumption; and reduces the perceived impact of nicotine on mucous sensory nerves.

It is contemplated that other compounds possessing most, if not all, of these properties should be suitable additions to nicotine-containing compositions for the nicotine reservoir of personal oral nicotine inhalers. Such compounds could include other glyceryl esters such as: the mono, di or tri esters with butyric acid or propionic acid and the mono and di-esters with acetic acid. Esters of 1,2 or 1,3 propanediol with acetic, propionic or butyric acid should also be suitable for the practice of the present invention. Additionally, numerous esters of ethanol including ethyl caprate, ethyl caprylate, ethyl levulinate, ethyl malonate and, ethyl tartrate should be usable for at least aspects of the practice of the present invention.

While esters are often preferred nicotine diluents for purposes of the present invention, this is not necessarily limiting to the practice of the present invention. Esters, being often characteristically volatile and composed of biologically compatible alcohols and acids, appear to often be acceptable nicotine diluents. Other potentially usable substances such as menthol and methyl salicylate frequently possess a substantial taste, or flavor. Still other types of potential nicotine diluents may be undesirably toxic or possibly toxic to humans.

The following examples are presented to even more fully enable one skilled in the art to practice a preferred embodiment of the present invention but are not meant to limit the scope of the invention unless otherwise specifically stated in the claims appended hereto.

EXAMPLE 1

Loading of Nicotine and Glyceryl Triacetate into Porous Solid-form Polyolefin Samples of porous solid-form polyolefin weighing about 360 mg and with a cylindrical shape about ¼ inch in diameter and ⅝ inch in length were obtained as porous high density polyethylene products from Porex Technologies (Fairburn, Ga.). A series of these samples were contacted with nicotine liquid with or without glycerol triacetate (both obtained from Eastman Kodak Co., Rochester, N.Y.).

The porous polyethylene samples absorbed both substances. The various amounts of nicotine and glyceryl triacetate used to treat each sample is shown in Table 1 as weight percentages of the polyethylene sample original weight, eighteen milligrams being 5%.

TABLE 1

POROUS POLYETHYLENE SAMPLE CONTENT OF ABSORBED NICOTINE AND GLYCERYL TRIACETATE

| Study No. | % Nicotine | % glyceryl triacetate |
|---|---|---|
| 1 | 5 | 0 |
| 2 | 5 | 0.16 |
| 3 | 5 | 0.31 |
| 4 | 5 | 0.625 |
| 5 | 5 | 1.25 |
| 6 | 5 | 2.5 |
| 7 | 5 | 5.0 |
| 8 | 5 | 7.5 |
| 9 | 3.75 | 3.75 |
| 10 | 2.5 | 2.5 |

EXAMPLE 2

Vaporization of Nicotine from Nicotine-Loading Porous Polyethylene Samples

The 360 mg pieces of Porex high density porous polyethylene loaded with nicotine (nic) or nicotine and glyceryl triacetate (qt) as described in Example 1 were interposed in the passageway of a tube. The tube was 84 mm long had an outer diameter of 5/16 inch and a wall thickness of about 5/1000 inch. Puffs of air (35 cc/puff) were drawn through the tube and nicotine-loaded porous polyethylene at about 1050 cc per minute (2 sec/-puff). The nicotine content of the air puffs was monitored by gas chromatography (Model 5880A, Hewlett Packard). Glyceryl triacetate was found not to interfere with gas chromatographic nicotine analysis.

Table 2 contains the data concerning nicotine in the air puffs. Table 3 shows the peak nicotine output per puff.

TABLE 2

NICOTINE EMISSION FROM POROUS SAMPLES

| Study No. | 1 | 2 | 3 | 4 | 5 | 6 | 7 | 8 | 9 | 0 |
|---|---|---|---|---|---|---|---|---|---|---|
| % nic. | 5 | 5 | 5 | 5 | 5 | 5 | 5 | 5 | 3.75 | 2.5 |
| % gt | 0 | 0.16 | 0.31 | 0.625 | 1.25 | 2.5 | 5 | 7.5 | 3.75 | 2.5 |
| Puff Number | Nicotine per Puff | | | | | | | | | |
| 1 | 8.3 | 7.4 | 9.6 | 5.1 | 4.0 | 6.1 | 3.8 | 3.8 | 4.6 | 4.5 |
| 33 | 8.6 | 8.2 | 9.1 | 7.2 | 6.8 | 6.6 | 6.2 | 5.6 | 7.1 | 4.9 |
| 65 | 9.1 | 7.3 | 7.9 | 7.8 | 7.1 | 6.6 | 6.6 | 5.7 | 7.7 | 4.3 |
| 97 | 9.3 | 6.6 | 7.0 | 7.9 | 7.1 | 6.4 | 6.6 | 5.4 | 8.0 | 3.9 |
| 128 | 9.1 | 6.1 | 6.2 | 8.0 | 6.8 | 6.2 | 6.6 | 5.3 | 8.1 | 3.7 |
| 160 | 8.4 | 5.7 | 5.7 | 7.9 | 6.5 | 6.2 | 6.5 | 5.1 | 8.1 | 3.5 |
| 192 | | | | 7.7 | 6.2 | 5.9 | 6.4 | 5.0 | 7.9 | 3.5 |
| 224 | | | | 7.4 | 6.0 | 5.7 | 6.3 | 4.9 | 7.6 | 3.4 |
| 256 | | | | 6.9 | 5.8 | 5.4 | 6.2 | 4.7 | 7.1 | 3.3 |
| 288 | | | | 6.6 | 5.6 | 5.1 | 6.1 | 4.6 | 6.8 | 3.3 |
| 320 | | | | 6.2 | 5.4 | 4.9 | 6.0 | 4.5 | 6.4 | 3.1 |
| 352 | | | | 5.7 | 5.2 | 4.6 | 5.9 | 4.4 | 6.0 | 3.0 |
| 383 | | | | 5.3 | 5.0 | 4.4 | 5.8 | 4.2 | 5.7 | 2.9 |
| 415 | | | | 5.0 | 4.9 | 4.2 | 5.7 | 4.1 | 5.4 | |
| 447 | | | | 4.7 | 4.6 | 4.1 | 5.5 | 3.9 | 5.1 | |
| 511 | | | | 4.6 | 4.5 | 4.0 | 5.4 | 3.8 | 4.8 | |
| 543 | | | | 4.4 | 4.3 | 3.8 | 5.3 | 3.7 | 4.6 | |
| 575 | | | | 4.2 | 4.0 | 3.7 | 5.2 | 3.6 | 4.4 | |
| 607 | | | | 4.1 | 4.0 | 3.6 | 5.1 | 3.7 | 4.2 | |
| 638 | | | | 4.0 | 3.8 | 3.6 | 5.1 | 3.6 | 4.0 | |
| 670 | | | | 3.9 | 3.8 | 3.5 | 5.0 | 3.5 | 3.8 | |
| 702 | | | | 3.8 | 3.7 | 3.4 | 4.9 | 3.5 | 3.7 | |
| 734 | | | | 3.8 | 3.7 | 3.3 | 4.8 | 3.4 | 3.6 | |
| 766 | | | | 3.6 | 3.7 | 3.3 | 4.8 | 3.3 | 3.5 | |
| 798 | | | | 3.6 | 3.7 | 3.2 | 4.7 | 3.2 | 3.4 | |
| 830 | | | | 3.5 | 3.7 | 3.2 | 4.6 | 3.2 | 3.2 | |
| 893 | | | | 3.4 | 3.6 | 3.2 | 4.6 | 3.1 | 3.2 | |
| 925 | | | | 3.4 | 3.4 | 3.1 | 4.6 | 3.1 | 3.2 | |
| 957 | | | | 3.4 | 3.3 | 3.0 | 4.5 | 3.0 | 3.1 | |
| 989 | | | | 3.2 | 3.2 | 3.0 | 4.4 | | 3.1 | |
| 1021 | | | | 3.2 | 3.2 | | 4.3 | | 3.0 | |
| 1053 | | | | 3.1 | 3.1 | | 4.3 | | | |
| 1085 | | | | 3.1 | 3.1 | | 4.2 | | | |
| 1116 | | | | 3.1 | 3.1 | | 4.1 | | | |
| 1148 | | | | 3.0 | 3.0 | | 4.0 | | | |
| 1180 | | | | 2.9 | 3.1 | | 3.9 | | | |

TABLE 3

PEAK NICOTINE EMISSIONS

| Study No. | % nic / % gt | ug Nicotine Puff |
|---|---|---|
| 1 | 5 / 0 | 9.3 |
| 2 | 5 / 0.16 | 8.2 |
| 3 | 5 / 0.31 | 9.6 |
| 4 | 5 / 0.625 | 8.0 |

TABLE 3-continued

| PEAK NICOTINE EMISSIONS | | |
|---|---|---|
| Study No. | % nic / % gt | ug Nicotine Puff |
| 5 | 5 / 1.25 | 7.1 |
| 6 | 5 / 2.5 | 6.6 |
| 8 | 5 / 7.5 | 5.7 |

As the data Table 1 and Table 3 show, glyceryl triacetate lessens the rate of nicotine emission to air passing through the nicotine-containing porous samples.

Data from Table 2 and analogously produced data is graphically shown in FIG. 1. Samples were loaded with nicotine as Study nos: 1 (5% nicotine/0% glyceryl triacetate (5% nic/0% gt); 4 (5% nic/0.625% gt); 5 (5% nic/1.25% gt); 6 (5% nic/2.5% gt); 7 (5% nic/5% gt); and 8 (5% nic/7.5% gt).

As may be seen in FIG. 1 and Table 3 nicotine emission is initially highest in the absence of glyceryl triacetate (see no. 1), nicotine emissions generally increase with increasing concentrations of glyceryl triacetate (an exception being Study No. 3). It is also noteworthy that certain levels of glyceryl triacetate (e.g. No.7) tend to decrease the early peak of nicotine emission and flatten the pattern of nicotine emission over a period of time.

EXAMPLE 3

Effects of Glyceryl Triacetate Upon Nicotine Impact and Flavoring of Smokeless Cigarettes A variety of smokeless cigarettes similar to those described in Example 1 were prepared. Samples for testing by volunteers were all prepared with 5% nicotine and about 0.1% tobacco flavoring of one or more varieties (percentages indicating a weight percent of the porous holder). These samples additionally contained: no glyceryl triacetate (gt); 0.5% gt; 0.625% gt; 1.25% gt; or 2.5% gt. In various coded combinations unknown to the volunteers, samples were given to these volunteers and their usage of the smokeless cigarette samples and evaluations thereof requested. In one set of circumstances a group of six volunteers were asked to comparatively evaluate smokeless cigarettes containing either no glyceryl triacetate or 0.625% glyceryl triacetate. All of the six individuals selected the 0.625% gt - containing sample as being smoother than the 0% gt sample. As shown by comparing the nicotine emissions of study no. 1 and study no. 4 shown in Table 3, peak nicotine output is decreased by about 13% with 0.62% gt. That this modest decrease in nicotine output resulted in a unanimous selection of the 0.625% gt sample as smoother, represented the surprising discovery that glyceryl triacetate, without a perceptible impact or flavor of its own, inhibits the irritative effects of nicotine on the sensation system of mucous tissues.

In further testing, it was generally agreed by volunteers that puffing and inhalation from 2.5% gt smokeless cigarettes and 1.25% gt smokeless cigarettes was much less irritative than when glyceryl triacetate was absent. In many cases with 2.5% gt (a 30% reduction in nicotine emission (Table 3, No. 6)) no nicotine irritative effect at all was reported.

Numerous subsequent smokeless cigarette testing with 5% nicotine, a variety of tobacco flavoring (0.1% or less) and with or without 0.5% gt were conducted. Tested individuals unanimously chose the 0.5% gt as smoother than the control and also noted that a negative alteration of flavor balance was not caused by the presence of glyceryl triacetate. Thus a smokeless cigarette containing nicotine and glyceryl triacetate in a weight/weight ratio between about 2 (e.g. 5% nic/2.5% gt i.e., the composition being about 66.67% nicotine) and about 10 (e.g. 5% nic/0.5% gt i.e., the composition being about 90.91% nicotine) were particularly preferred.

Changes may be made in the arrangement of the various parts, elements, steps and procedures described herein without departing from the concept and scope of the invention as defined in the following claims.

What is claimed is:

1. A smokeless nicotine inhaler consisting essentially of:
   - a housing having a first open end and a mouthpiece open end, said housing defining a tubular passageway between the first open end and the mouthpiece open end;
   - a reservoir in the passageway adapted to contain and liberate a volatile fluid comprising nicotine into air passing through said passageway, said reservoir being a porous solid-form synthetic polymer; and
   - a fluid contained in said reservoir, the fluid comprising nicotine and a volatile nicotine-miscible substance in a weight/weight ratio between about 2.0 and about 10.0, said volatile substance having a normal boiling point between about 175° C. and about 275° C.

2. The smokeless nicotine inhaler of claim 1 wherein the volatile nicotine-miscible substance is an ester.

3. The smokeless nicotine inhaler of claim 1 wherein the volatile nicotine-miscible substance accompanies nicotine vaporized from the reservoir and reduces sensory impact of vaporized nicotine on oral, pharyngeal or lung mucousal tissue.

4. The smokeless nicotine inhaler of claim 1 wherein the volatile nicotine-miscible substance is glyceryl triacetate.

5. The smokeless nicotine inhaler of claim 1 wherein the volatile nicotine-miscible substance is generally regarded as safe for human consumption.

6. The smokeless nicotine inhaler of claim 1 wherein the polymer is a polyolefin.

7. The smokeless nicotine inhaler of claim 1 wherein the polymer is polyethylene.

8. A smokeless nicotine inhaler consisting essentially of:
   - a housing having a first open end and a mouthpiece open end, said housing defining a tubular passageway between the first open end and the mouthpiece open end;
   - a porous solid-form polymeric reservoir contained in the passageway, said reservoir being adapted to contain volatile fluid and liberate the volatile fluid into air passing through said passageway; and
   - a fluid contained in said reservoir, the fluid consisting essentially of nicotine and a diol or triol at least partially esterified with an alkyl carboxylic acid having less than five carbon atoms to produce an ester having a normal boiling point between about 175° C. and about 275° C., the nicotine and ester being in a weight/weight ratio between about 0.5 and about 40.0.

9. A smokeless nicotine inhaler consisting essentially of:

a housing having a first open end and a mouthpiece open end, said housing defining a tubular passageway between the first open end and the mouthpiece open end;

a pourous solid-form polymeric reservoir contained in the passageway adapted to contain volatile fluid and liberate volatilized fluid into air passing through said passageway; and a volatile fluid contained in said reservoir, the fluid consisting essentially of nicotine and an ester of ethanol with an alkyl carboxylic acid, the ester having a normal boiling point between about 175° C. and about 275° C., said nicotine and ester having a weight/weight ratio between about 0.5 and about 40.0.

10. A smokeless nicotine inhaler consisting essentially of:

a housing having a first open end and a mouthpiece open end, said housing defining a tubular passageway between the first open end and the mouthpiece open and;

a nicotine reservoir contained in the passageway to liberate nicotine into air passing through said passageway; and a composition contained in said nicotine reservoir, the composition consisting essentially of nicotine and glyceryl triacetate in a weight/weight ratio between about 0.5 and about 40.

11. The smokeless nicotine inhaler of claim 10 wherein the fluid comprises nicotine and glyceryl triacetate in a weight/weight ratio between about 2 and about 10.

* * * * *

UNITED STATES PATENT AND TRADEMARK OFFICE

CERTIFICATE OF CORRECTION

PATENT NO. : 4,917,120

DATED : April 17, 1990

INVENTOR(S) : Ira D. Hill

It is certified that error appears in the above-identified patent and that said Letters Patent is hereby corrected as shown below:

In claim 9, column 9, line 6, delete the term "pourous" and insert the term --porous--.

Signed and Sealed this

Fifteenth Day of October, 1991

*Attest:*

HARRY F. MANBECK, JR.

*Attesting Officer*

*Commissioner of Patents and Trademarks*